US007014433B2

(12) United States Patent
Nieter

(10) Patent No.: US 7,014,433 B2
(45) Date of Patent: Mar. 21, 2006

(54) SHAPED VALVE SEATS IN DISPLACEMENT COMPRESSORS

(75) Inventor: Jeffrey James Nieter, Coventry, CT (US)

(73) Assignee: Carrier Corporation, Syracuse, NY (US)

( * ) Notice: Subject to any disclaimer, the term of this patent is extended or adjusted under 35 U.S.C. 154(b) by 25 days.

(21) Appl. No.: 10/366,133

(22) Filed: Feb. 13, 2003

(65) Prior Publication Data

US 2004/0161352 A1 Aug. 19, 2004

(51) Int. Cl.
*F04B 39/10* (2006.01)
*F16K 15/16* (2006.01)

(52) U.S. Cl. ..... 417/569; 137/855

(58) Field of Classification Search ..... 417/569, 417/566; 137/855–858; 251/359; 277/502
See application file for complete search history.

(56) References Cited

U.S. PATENT DOCUMENTS

| | | | | |
|---|---|---|---|---|
| 4,580,604 | A * | 4/1986 | Kawaguchi et al. | 137/856 |
| 5,178,183 | A * | 1/1993 | Kim | 137/527 |
| 5,266,016 | A * | 11/1993 | Kandpal | 417/569 |
| 5,346,373 | A * | 9/1994 | Riffe | 417/415 |
| 5,655,898 | A * | 8/1997 | Hashimoto et al. | 417/569 |
| 6,116,866 | A * | 9/2000 | Tomita et al. | 417/413.2 |
| 6,309,194 | B1 * | 10/2001 | Fraser et al. | 417/569 |

FOREIGN PATENT DOCUMENTS

| | | | |
|---|---|---|---|
| JP | 56138571 | A * | 10/1981 |
| JP | 07110075 | A * | 4/1995 |

* cited by examiner

*Primary Examiner*—Charles G. Freay
(74) *Attorney, Agent, or Firm*—Bachman & LaPointe, P.C.

(57) ABSTRACT

A valve assembly including a valve seat and a valve member movable relative to the valve seat between an open position and a closed position and defining in the closed position a high pressure side and a low pressure side, the valve member further being deformable to a deformed shape in the closed position, and the valve seat having a seat edge adapted to conform to the valve member in the deformed shape.

19 Claims, 3 Drawing Sheets

SHAPED VALVE SEATS IN DISPLACEMENT COMPRESSORS

BACKGROUND OF THE INVENTION

The invention relates to valve assemblies and, more particularly, to displacement compressors using valve assemblies.

In displacement compressors that use valves, such as reciprocating piston compressors and the like, pressure actuated valves typically open and close once during each shaft revolution of the compressor. When the valve closes, it contacts the valve seat due to valve stiffness and/or pressure actuation. Depending upon compressor design and application, this contact can occur with a velocity that can be substantial, producing an impact between these components which also can be substantial.

While the valve is closed, it supports a pressure difference. The magnitude of this pressure difference depends upon the compression application.

The nominal maximum pressure difference supported by both suction and discharge valves in a reciprocating compressor is simply the difference between the discharge (high) and suction (low) pressures. If the valve is relatively thin, such as, for example, a reed type valve, then the valve in the closed position will deflect into the port somewhat due to the pressure difference. This deflection into the port will cause the portion of the valve contacting the valve seat to slide against the valve seat. This sliding motion produces wear of the material at the valve seat and the valve.

In many common applications, the valve deflection, and the sliding between valve and valve seat, is relatively small due to valve and valve seat design, compressor design, and/or applications with only low to moderate pressure differences. However, some applications may require the use of a thin reed type valve to support a high pressure difference. In these cases, the wear at the valve seat and valve may be significant, and this results in reduced useful life of the compressor and reduced performance due to leakage of compressed fluid between the valve and valve seat.

It is clear that the need remains for a reduction of the localized stresses that lead to material wear in the contact zone of the valve and valve seat, as well as a reduction of leakage.

It is therefore the primary object of the present invention to provide a valve assembly and compressor incorporating same which addresses these needs.

Other objects and advantages of the present invention will appear hereinbelow.

SUMMARY OF THE INVENTION

In accordance with the present invention, the foregoing objects and advantages have been readily attained.

According to the invention, a valve assembly is provided, which comprises a valve seat; and a valve member movable relative to said valve seat between an open position and a closed position and defining in said closed position a high pressure side and a low pressure side, said valve member further being deformable to a deformed shape in said closed position, and said valve seat having a seat edge adapted to conform to said valve member in said deformed shape.

In further accordance with the present invention, a compressor assembly is provided, which comprises a housing defining a high pressure zone and a low pressure zone and having a port communicating said high pressure zone and said low pressure zone; a valve seat positioned around said port; and a valve member movable relative to said valve seat between an open position wherein flow through said port is allowed and a closed position wherein flow through said port is blocked, said valve member being deformable to a deformed shape in said closed position, and said valve seat having a seat edge adapted to conform to said valve member in said deformed shape.

BRIEF DESCRIPTION OF THE DRAWINGS

A detailed description of preferred embodiments of the present invention follows, with reference to the attached drawings, wherein.

DETAILED DESCRIPTION

The invention relates to a valve assembly and, more particularly, to a valve assembly including shaped valve seats, and to compressors incorporating same, wherein deformation of the valve member does not lead to excessive wear of the valve seat and/or valve member, thereby increasing the useful life and efficiency of the compressor or other machine incorporating the valve assembly.

Figure 1:
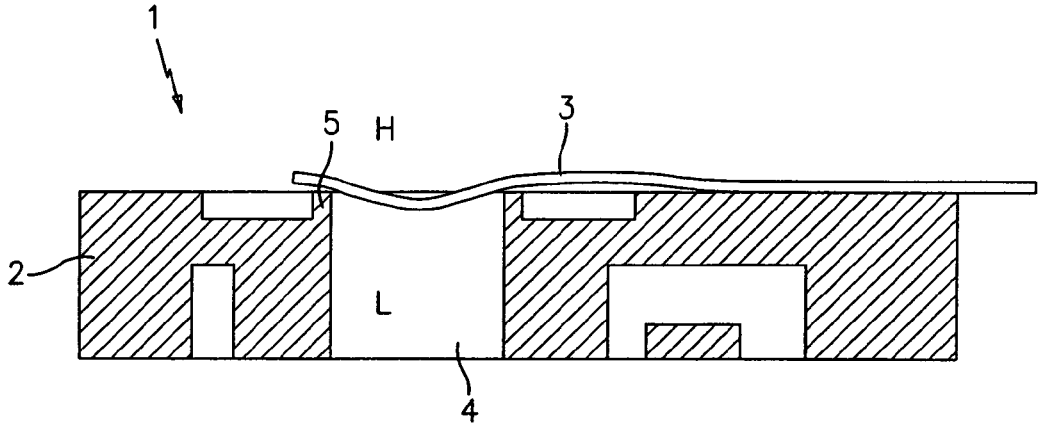
FIG. 1 (PRIOR ART)
FIG. 1 schematically illustrates a conventional valve seat and valve member wherein excessive wear at valve seat edges can occur.

FIG. 1 illustrates a conventional valve assembly 1 including a valve plate 2 and a valve member 3. When closed, as shown in FIG. 1, valve member 3 defines a zone of high pressure H and a zone of low pressure L, and the high pressure zone causes deformation of valve member 3 into the port 4 as shown. As discussed above, this results in sliding of valve member 3 relative to seat 5 of valve plate 2, which causes wear at this point, and leads to leakage from high pressure zone H to low pressure zone L, thereby adversely impacting upon efficiency of the compressor incorporating the valve.

Figure 2:
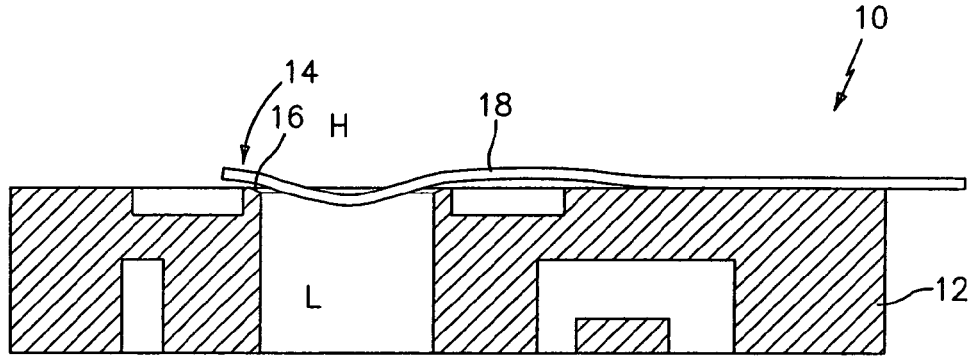
FIG. 2 schematically illustrates a valve seat and valve assembly in accordance with the present invention.

FIG. 2 shows a valve assembly 10 in accordance with the present invention, wherein a valve plate 12 is provided having a valve seat 14 including a valve edge 16 that is adapted to conform to a deformed shape of valve member 18 when valve member 18 is in a closed position defining high pressure zone H and low pressure zone L. Seat edge 16 is adapted to conform to the deformed shape of valve member 18, and thereby avoids friction, sliding and excessive wear due to this deformation, thus enhancing useful lifetime of the valve assembly and compressor incorporating same, and preventing reduction in compressor efficiency due to leakage at the valve.

Figure 3:
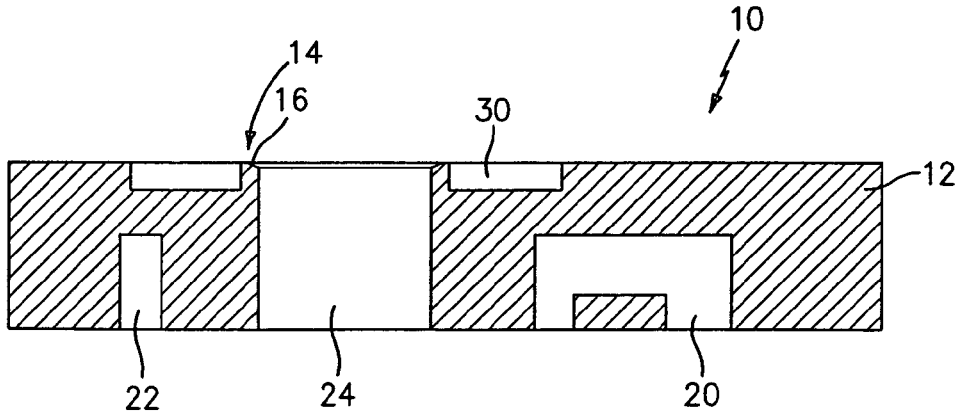
FIGS. 3 and 3*a* further illustrate a preferred embodiment of a valve seat structure in accordance with the present invention.

FIG. 3 further illustrates valve plate 12 including valve seat 14 in accordance with the present invention. As shown, valve plate 12 may typically be a suitable plate structure adapted for mounting in the desired application, which in the preferred embodiment of the present invention is a compressor as will be further described below. Plate 12 may typically include various flow passages 20, and flow ports 22 and 24, as shown.

Figure 3A:
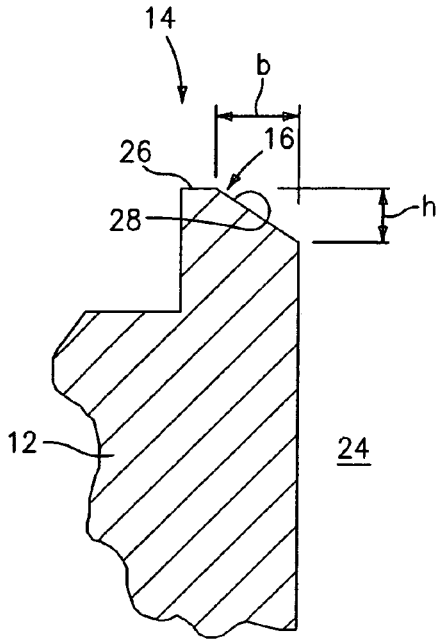

FIG. 3*a* further illustrates seat edge 16 in accordance with the present invention, and shows seat edge 16 including an end face portion 26 and an angled portion 28. End face portion 26 is preferably substantially parallel to the plane of the undeformed valve member 18, while angled portion 28 is the portion which, in accordance with the present invention, is advantageously adapted to conform to the shape or slope of the substantially adjacent portion of valve member 18 when in the closed position and deformed shape. In accordance with the present invention, it has been found that when the pressure differential across valve member 18 causes deformation of same, the contacting surface portion of valve member 18 which engages valve seat 16 is at a slope relative to the plane of the undeformed portion of valve member 18, and angled portion 28 is preferably provided having an angle height h and an angle width b as shown in FIG. 3*a*, and the ratio h/b is preferably adapted to be substantially the same as the slope of valve member 18 in the contacting surface portion of the deformed shape. Thus, angled portion 28 slopes toward low pressure zone L from end face portion 26, and the value of the angle A is defined as follows:

$$A=\arctan(h/b),$$

wherein:

A is the value of the angle;

h is a vertical component of angled portion 28 as shown in FIG. 3*a*; and b is a horizontal component of angled portion 28 as shown in FIG. 3*a*.

As shown in the embodiment of FIG. 3, port 24 is for discharge flow and port 22 is for suction flow; passage 20 provides for flow to pass to port 22.

Figure 4:
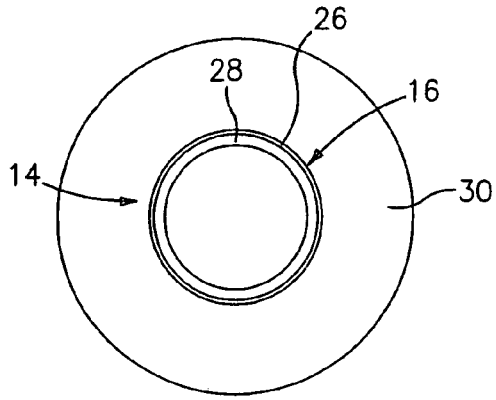
FIG. 4 illustrates a top view of a valve seat in accordance with a preferred embodiment of the present invention.

FIG. 4 shows a top view of a portion of valve plate 12 in accordance with the present invention, and further shows seat edge 16 including end face 26 and angled portion 28. As shown in FIG. 4, and also in FIGS. 2 and 3, a recessed area 30 may advantageously be defined around seat edge 16. Recessed area 30 improves valve operation by insuring that surrounding plate material does not interfere with valve motion and seat contact. This further reduces contact area between the valve and plate to avoid conditions which could lead to impeded valve motion.

Figure 5A:
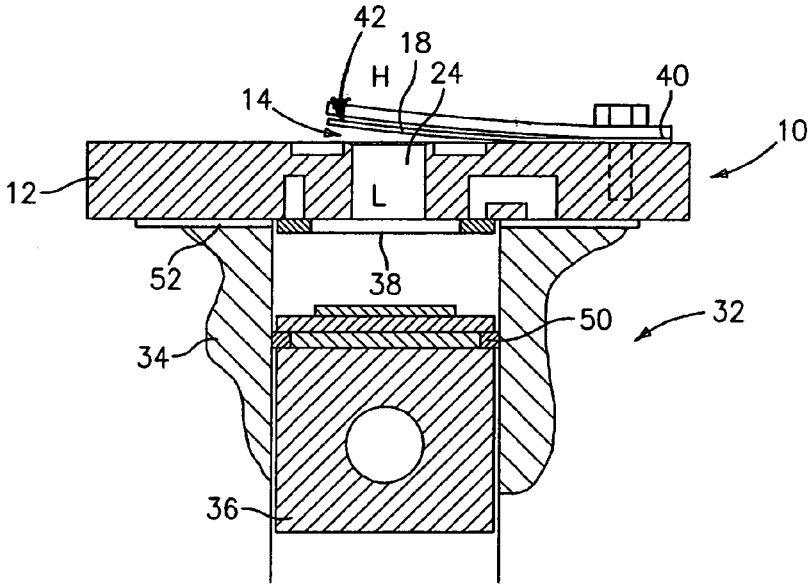
FIGS. 5 and 5*a* illustrate a side view of a valve assembly incorporated into a compressor in accordance with the present invention with the valve open (FIG. 5*a*) and closed (FIG. 5)
Figure 5:
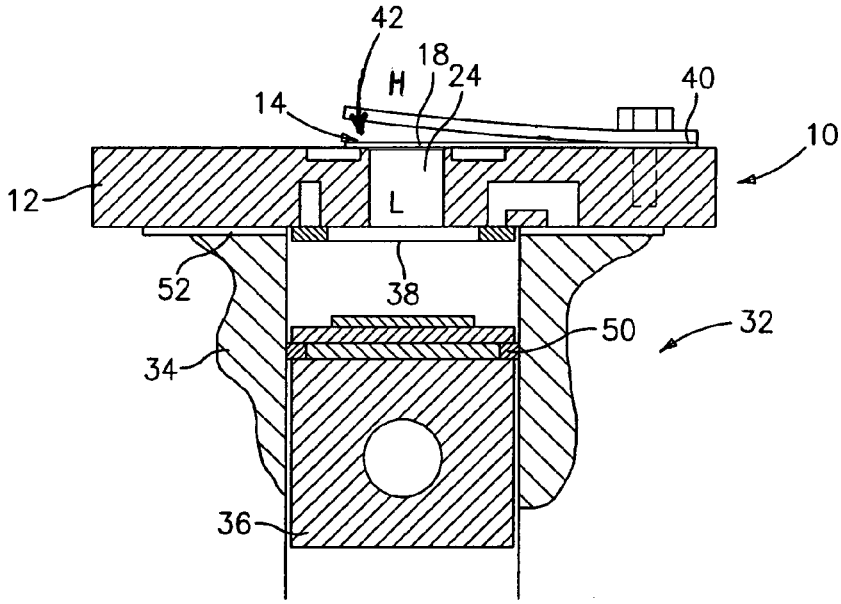

FIGS. 5 and 5*a* illustrate a valve assembly 10 in accordance with the present invention incorporated into a compressor 32, a portion of which is illustrated. Compressor 32 includes a housing 34, a piston 36 disposed therein, an annular ring suction valve 38, a piston seal ring 50 and a gasket 52 positioned between housing 34 and valve plate 12. These elements in combination with valve plate 12 and valve member 18 define a high pressure zone H and a low pressure zone L. Reciprocating piston 36 positioned within housing 34 provides the desired function of compressor 32. During operation, as piston 36 displaces fluid through port 24, valve member 18 is displaced to the open position shown in FIG. 5*a*, and flow is allowed. Upon rearward reciprocation of piston member 36, valve member 18 moves back to a closed position such as that illustrated in FIGS. 2 and 5, and is deformed as illustrated in FIG. 2 by the ensuing high pressure differential across the valve. The angled valve seat edge 16 in accordance with the present invention advantageously conforms to the slope of the deformed valve member in the closed position, and thereby minimizes friction or other adverse movement between valve member 18 and valve seat edge 16, thereby reducing wear on these parts and extending the useful lifetime of the valve assembly as desired.

Reciprocating piston 36 and piston seal ring 50 are positioned within housing 34 for providing the desired function of compressor 32, and valve plate 12 is secured to housing 34 including gasket 52, and discharge port 24 of valve plate 12 is substantially aligned with the opening in annular suction ring valve 38. During operation, as piston 36 moves upward during the compression stroke, it compresses fluid until such pressure is achieved that it displaces fluid through discharge port 24 by displacing discharge valve member 18 to the open position, allowing discharge flow of the compressed fluid. Upon rearward reciprocation of piston member 36, fluid is expanded and discharge valve member 18 moves back to the closed position such as that illustrated in FIGS. 2 and 5, and is deformed by the ensuing high pressure differential across the discharge valve.

It should be appreciated that this disclosure is provided in the form of a valve assembly employed as a discharge valve. The present invention applies equally to the suction valve, which is not further described herein as it would be repetitive.

Figure 6:
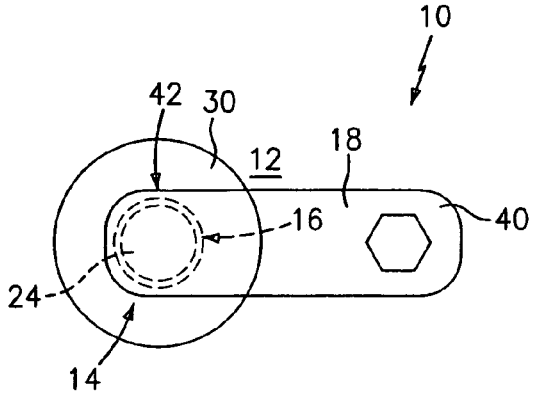
FIG. 6 is a top illustration of a portion of the valve assembly of FIG. 5.

As shown also in FIG. 6, in this type of embodiment, valve member 18 may advantageously be provided as a substantially elongate member having one end 40 which is secured to valve plate 12, and having another end 42 which is adapted to define the sealing portion of valve member 18. In such a configuration, valve member 18 is provided of a substantially flexible and thin material, such as a reed valve, and this is precisely the type of valve wherein the need for the advantages of the present invention are rendered most acute.

Figure 7:
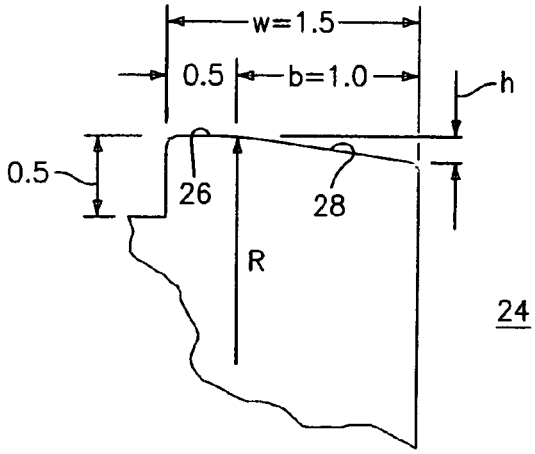
FIG. 7 illustrates another embodiment of a valve seat configuration according to the invention.

Turning now to FIG. 7, a further embodiment of the present invention is illustrated. In accordance with this embodiment of the present invention, sloped portion 28 of FIG. 3*a* is now provided as a curved portion, and curves at a radius from end face portion 26 toward the low pressure zone defined by the valve.

The radius of curved portion 28 in FIG. 7 is advantageously provided having a value R which is defined as follows:

$$R=(b^2+h^2)/(2h)$$

wherein:

R is the value of the radius;

h is the vertical component of curved portion 28 as shown in FIG. 7;

b is a horizontal component of curved portion 28 as shown in FIG. 7; and values h and b are the same as defined above to provide angle A.

The angle as set forth above is measured as between a line drawn from beginning and end points of curved portion 28 as compared to the plane of end face portion 28. In this regard, the angle defined above is also preferably utilized as the angle of sloped portion 28 relative to end face portion 26 for the embodiment wherein sloped portion 28 is substantially planar, as illustrated for example in FIG. 3*a*.

It should be appreciated that the valve assembly in accordance with the present invention can readily be adapted to a wide variety of applications wherein valve member deformation is an issue. Such diverse applications are well within the broad scope of the present invention. However, a particularly preferred embodiment and area of use is as is illustrated in FIG. 5, in a compressor using thin or reed type valves, especially in a reciprocating compressor and/or a compressor using $CO_2$ as working fluid, wherein valve wear and reduced efficiency due to leakage are both minimized by the valve assembly in accordance with the present invention.

It should also be appreciated that although a particular type of compressor is illustrated in FIG. 5, the valve assembly of the present invention could readily be incorporated into other types of displacement compressors as well, and would provide equally desirable advantages.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A valve assembly, comprising:

a valve seat; and a valve member movable relative to said valve seat between an open position and a closed position and defining in said closed position a high pressure side and a low pressure side, said valve member further being deformable to a deformed shape in said closed position, and said valve seat having a seat edge adapted to conform to said valve member in said deformed shape, wherein said valve seat is defined on a valve plate member and wherein said valve member is an elongate member secured to said valve plate member at one end and defining a valve closure portion at the other end which extends from one side of said valve seat away from said one end and over an opposite side of said valve seat, wherein said seat edge at said opposite side is sloped radially inwardly toward said low pressure side, said valve closure portion being adapted to engage said valve seat in said closed position.

2. The assembly of claim 1, wherein said valve member is a substantially flat member.

3. The assembly of claim 1, wherein said valve member in said deformed shape has a slope substantially adjacent to said seat edge, and wherein said seat edge has an angle width b and an angle height h, and wherein a ratio of h/b is substantially the same as said slope.

4. The assembly of claim 1, wherein said valve plate member further includes a recessed area defined around at least a portion of said seat edge.

5. The assembly of claim 1, wherein said seat edge has an end face portion and an angled portion, said end face being substantially parallel to a plane of said undeformed valve member in said closed position, and said angled portion sloping toward said low pressure side from said end face portion.

6. The assembly of claim 5, wherein said angled portion defines an angle with said end face portion, and wherein said angle has a value A defined as follows:

$$A=\arctan(h/b)$$

wherein:

A is said value of said angle;

h is a vertical component of said sloped portion; and b is a horizontal component of said sloped portion.

7. The assembly of claim 1, wherein said seat edge at said opposite side has an end face portion and a curved portion having a radius, said curved portion extending radially inwardly and curving toward said low pressure side from said end face portion.

8. The assembly of claim 7, wherein said radius has a value R defined as follows:

$$R=(h^2+b^2)/(2h)$$

wherein:

R is said value of said radius;

h is a vertical component of said curved portion; and b is a horizontal component of said curved portion.

9. The assembly of claim 8, wherein said curved portion is defined between a beginning point and an end point, wherein a line drawn through said beginning point and said end point is at an angle with respect to said end face portion, and wherein said angle has a value A defined as follows:

$$A=\arctan(h/b)$$

wherein:

A is said value of said angle;

h is a vertical component of said curved portion; and b is a horizontal component of said curved portion.

10. A compressor assembly, comprising:

a housing defining a high pressure zone and a low pressure zone and having a port communicating said high pressure zone and said low pressure zone;

a valve seat positioned around said port; and a valve member movable relative to said valve seat between an open position wherein flow through said port is allowed and a closed position wherein flow through said port is blocked and defining in said closed position a high pressure side and a low pressure side, said valve member further being deformable to a deformed shape in said closed position, and said valve seat having a seat edge adapted to conform to said valve member in said deformed shape, wherein said valve seat is defined on a valve plate member and wherein said valve member is an elongate member secured to said valve plate member at one end and defining a valve closure portion at the other end which extends from one side of said valve seat away from said one end and over an opposite side of said valve seat, wherein said seat edge at said opposite side is sloped radially inwardly toward said low pressure side, said valve closure portion being adapted to engage said valve seat in said closed position.

11. The compressor assembly of claim 10, wherein said valve member is a substantially flat member.

12. The compressor assembly of claim 10, wherein said valve member in said deformed shape has a slope substantially adjacent to said seat edge, and wherein said seat edge has an angle width b and an angle height h, and wherein a ratio of h/b is substantially the same as said slope.

13. The assembly of claim 10, wherein said valve plate member further includes a recessed area defined around at least a portion of said seat edge.

14. The compressor assembly of claim 10, wherein said seat edge at said opposite side has an end face portion and an angled portion, said end face being substantially parallel to a plane of said undeformed valve member in said closed position, and said angled portion extending radially inwardly and sloping toward said low pressure side from said end face portion.

15. The assembly of claim 14, wherein said angled portion defines an angle with said end face portion, and wherein said angle has a value A defined as follows:

$$A=\arctan(h/b)$$

wherein:

A is said value of said angle;

h is a vertical component of said sloped portion; and b is a horizontal component of said sloped portion.

16. The assembly of claim 10, wherein said seat edge has an end face portion and a curved portion having a radius, said curved portion curving toward said low pressure side from said end face portion.

17. The assembly of claim 16, wherein said radius has a value R defined as follows:

$$R=(h^2b^2)/(2h)$$

wherein:

R is said value of said radius;

h is a vertical component of said curved portion; and b is a horizontal component of said curved portion.

18. The assembly of claim 17, wherein said curved portion is defined between a beginning point and an end point, wherein a line drawn through said beginning point and said end point is at an angle with respect to said end face portion, and wherein said angle has a value A defined as follows:

$$A=\arctan(h/b)$$

wherein:

A is said value of said angle;

h is a vertical component of said curved portion; and b is a horizontal component of said curved portion.

19. The compressor assembly of claim 10, wherein said housing defines a reciprocating compressor.

* * * * *